US007428868B2

(12) United States Patent
Petri

(10) Patent No.: US 7,428,868 B2
(45) Date of Patent: Sep. 30, 2008

(54) DEVICE, KIT AND METHOD FOR CLEANING ROLLS IN PRINTING MACHINES

(75) Inventor: Stefano Petri, Capannori (IT)

(73) Assignee: Fabio Perini, Viareggio (Lucca) (IT)

( * ) Notice: Subject to any disclaimer, the term of this patent is extended or adjusted under 35 U.S.C. 154(b) by 50 days.

(21) Appl. No.: 10/598,624

(22) PCT Filed: Feb. 28, 2005

(86) PCT No.: PCT/IT2005/000109

§ 371 (c)(1),
(2), (4) Date: Sep. 6, 2006

(87) PCT Pub. No.: WO2005/084951

PCT Pub. Date: Sep. 15, 2005

(65) Prior Publication Data

US 2007/0175348 A1 Aug. 2, 2007

(30) Foreign Application Priority Data

Mar. 4, 2004 (IT) ..... FI2004A0051

(51) Int. Cl.
*B41F 35/00* (2006.01)

(52) U.S. Cl. ..... 101/425; 101/424

(58) Field of Classification Search ..... 101/423–425
See application file for complete search history.

(56) References Cited

U.S. PATENT DOCUMENTS 4,121,311 A * 10/1978 Meyer ..... 8/149.3
4,258,450 A * 3/1981 Sohler ..... 15/312.2
5,330,105 A * 7/1994 Kaylor ..... 239/400
5,603,775 A 2/1997 Sjoeberg
5,783,044 A * 7/1998 Schneider et al. ..... 162/278
6,006,666 A * 12/1999 Gottling ..... 101/425
6,561,096 B1 5/2003 Munz
6,799,514 B2 * 10/2004 Boatman et al. ..... 101/425
6,810,807 B2 * 11/2004 Hebert ..... 101/424
6,957,607 B2 * 10/2005 Biagiotti ..... 101/424
2002/0104454 A1 * 8/2002 Verschueren ..... 101/450.1
2003/0167948 A1 9/2003 Weitz
2003/0178048 A1 9/2003 Honkala et al.

FOREIGN PATENT DOCUMENTS

EP 0 570 879 A2 11/1993
EP 0 928 687 A1 7/1999
JP 63-4947 1/1988
WO WO01/54909 8/2001
WO WO 2004/108416 12/2004

* cited by examiner

*Primary Examiner*—Anthony H. Nguyen
(74) *Attorney, Agent, or Firm*—McGlew & Tuttle, P.C.

(57) ABSTRACT

Device for cleaning rolls in printing machines, specially machines for executing prints on web-shaped paper-like material destined to the production of tissue paper, napkins, toilet paper and the like, characterized by the fact that it comprises: a nozzle (1) apt to direct a steam jet toward the surface of a roll (2, 3) to be cleaned: said nozzle (1) being connected to steam feeding means; a suction chamber (5) within which is disposed said nozzle (1) and apt to execute an aspiration in correspondence of the surface of the roll (2, 3) interested by the steam et supplied by the nozzle (1): said chamber (5) being connected to relevant suction means; a plurality of holes (7, 8) oriented toward the surface of the roll (2, 3) to be cleaned, and connected to air compressed feeding means.

20 Claims, 3 Drawing Sheets

DEVICE, KIT AND METHOD FOR CLEANING ROLLS IN PRINTING MACHINES

The present invention refers to a device, a kit and a method for cleaning rolls in printing machines, especially machines for executing prints on web-shaped paper material destined to the production of tissue paper, handkerchiefs, toilet paper and the like.

It is known that the printing machines, and particularly those employed for executing prints on materials of the aforesaid type, comprise at least a driving cylinder around which the web-shaped material to be printed travels and at least a cliché roll on which the ink is distributed. The ink is distributed on the cliché roll by a so called screened roll, or "anilox" roll, disposed between the same cliché roll and an ink reservoir. During the printing, the web-shaped material travels between the surface of the driving roll and the inked surface of the cliché roll: said driving roll and said cliché roll rotating around the respective longitudinal axis, which are parallel to each other, and their rotation involves the advancing of the web-shaped material. A printing machine of this type is described, for example, in WO 01/54909.

It is also known that both the cliché roll and the anilox roll are subject to paper-dust formations and, more in general, also by masses of partially dried ink which, if not timely removed, determine a progressive and drastic reduction of the printing quality.

Therefore, cleaning devices are used which are provided with a nozzle delivering a pressurized fluid, i.e. compressed air or pressurized water, oriented toward the surface of the roll to be cleaned. These devices are provided also with a suction section through which the fluid with the dirt removed from the roll surface is sucked, and thus moved away. A cleaning device utilizing compressed air is described in JP-63004947. A cleaning device utilizing pressurized water is described in IT-FI/95/A/137.

Both the cleaning devices utilizing compressed air and the devices utilizing pressurized water have drawbacks that make them not suitable for the present production requirements. More particularly, relating to the compressed air devices, the action of the air is practically insufficient or ineffective, especially with respect to the dry ink residuals. This drawback is even more evident when certain types of ink are used which exhibit a more strong adherence to the roll surface.

The device utilizing pressurized water determine an excessive water consumption, with the necessity of an expensive depuration of the water before its re-utilization or the discharge. However, the recycling of the water is limited by the fact that the concentration of the removed substances from the cleaned rolls progressively increases during the operations, until the recycled water is no longer usable. The main object of the present invention is to eliminate or at least strongly reduce the said drawbacks.

This result has been achieved, according to the invention, by adopting the idea of a device, a method and a kit having the characteristics described in the independent claims. Further characteristics being set forth in the dependent claims.

The advantages deriving form the present invention lies in that it is possible, by utilizing steam, to drastically reduce the consumption of the water utilized for cleaning the rolls and to expedite the drying of the same, without compromising the effectiveness of the thus executed cleaning and, consequently, the printing quality. Experimental tests executed by the inventor have ascertained that, in the same conditions (i.e. length and surface of the roll, translation speed of the nozzle along the roll surface, type of ink, etc.) the steam production requires an amount of water about 20-30 less than the amount of water utilized by a known water cleaning device.

Another advantage derives from that the heat of the steam contributes synergically to increase the mechanical cleaning effect due to the impact of the steam on the surface of the roll. Advantageously, it is possible to increase the cleaning action by adding a detergent to the liquid from which is formed the steam.

Moreover, a device according to the invention is relatively easy to make, cost-effective and reliable even after a prolonged service life.

These and other advantages and characteristics of the invention will be best understood by anyone skilled in the art from a reading of the following description in conjunction with the attached drawings given as a practical exemplification of the invention, but not to be considered in a limitative sense, wherein.

Figure 1:
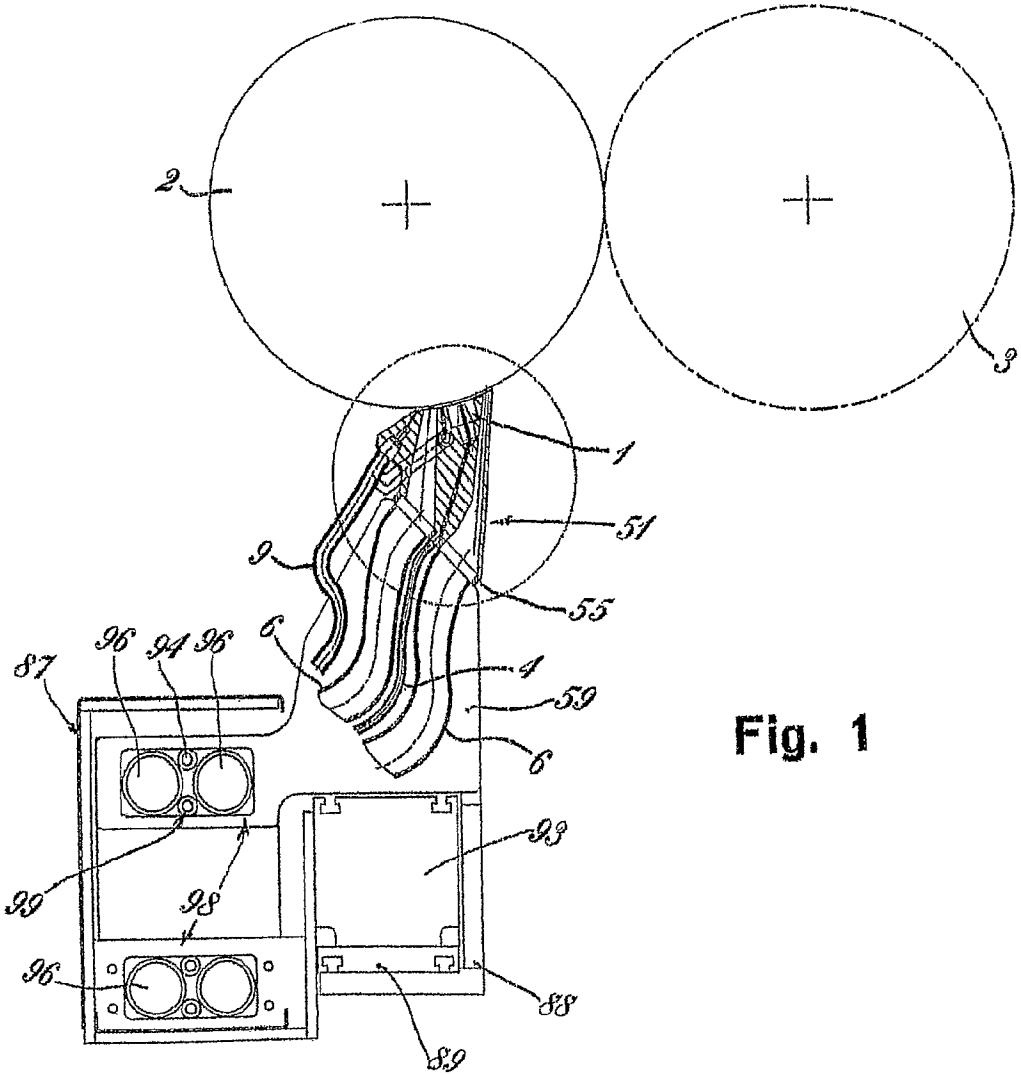
FIG. 1 is a schematic cross sectional view of a device according to the invention, acting on the surface of a cliché roll.
Figure 2:
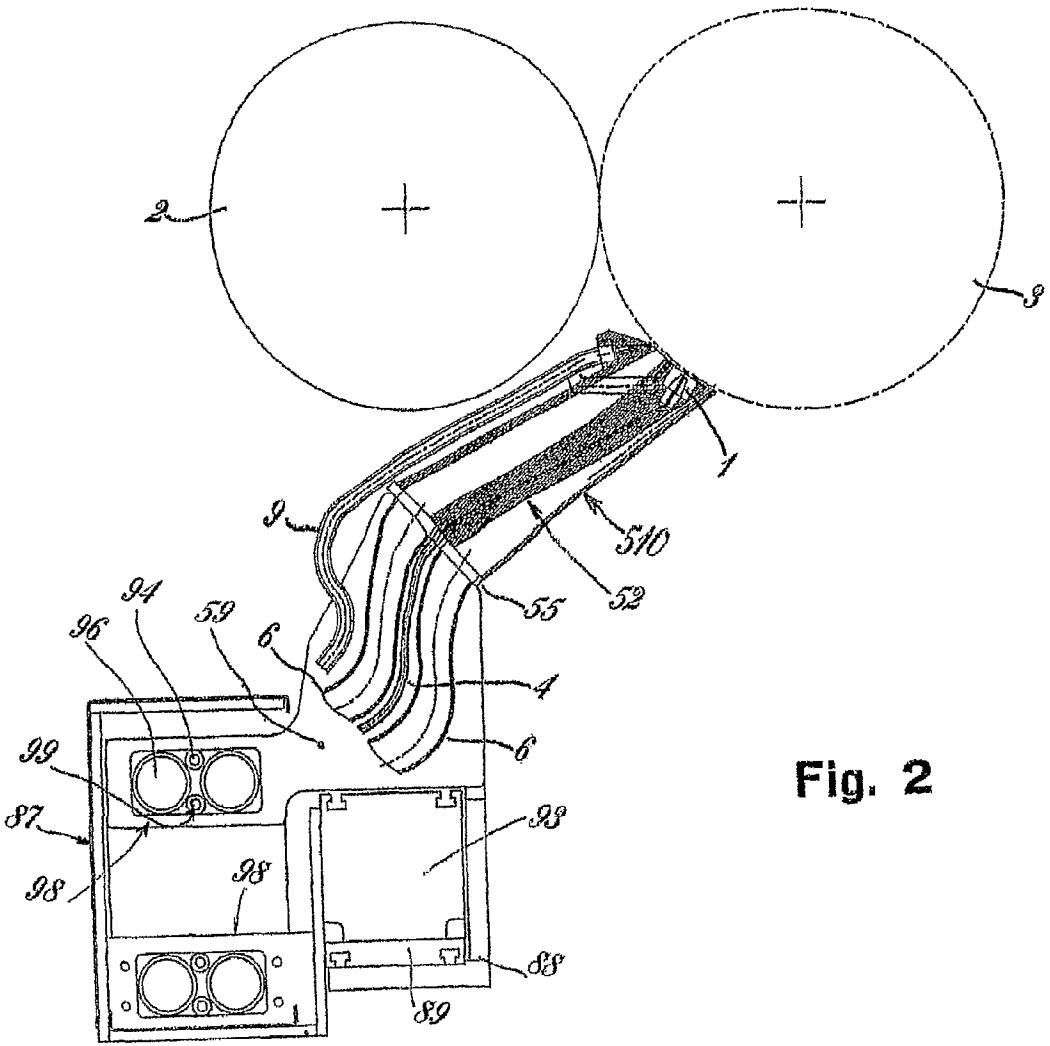
FIG. 2 is a schematic cross sectional view of a device according to the invention, acting on the surface of an anilox roll.
Figure 4:
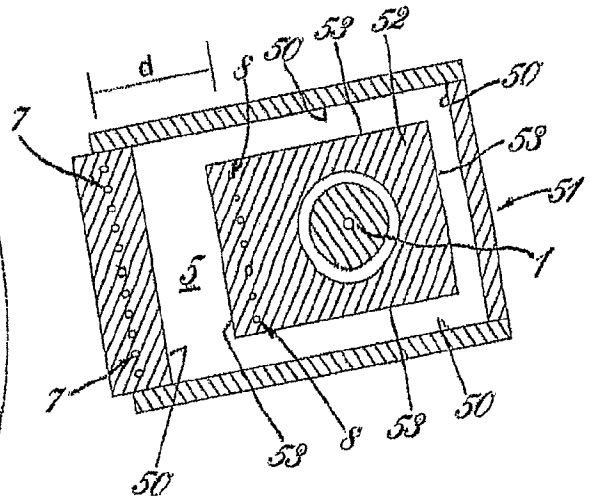
FIG. 4 is a sectional view according to the line H-H of FIG. 3.
Figure 3:
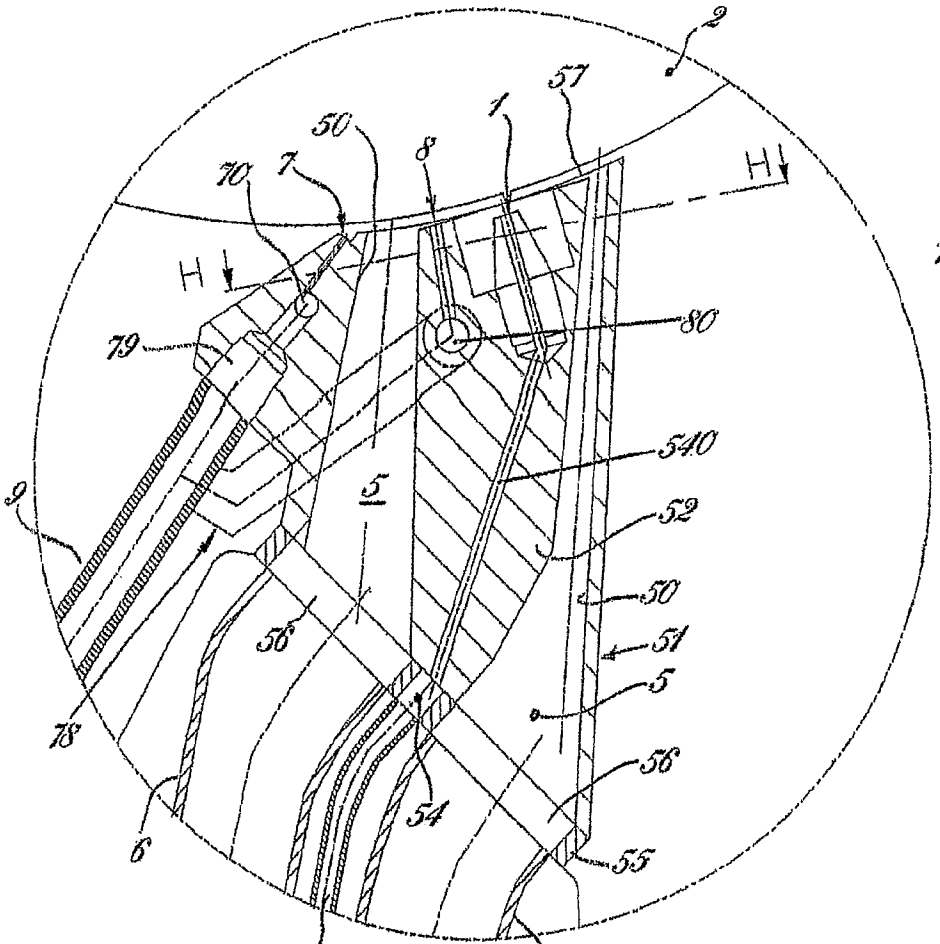
FIG. 3 shows an enlarged particular of FIG. 1.

Reduced to its basic structure, and reference being made to the figures of the attached drawings, a device for cleaning cliché or anilox rolls in machines for executing prints on web-shaped paper-like material according to the invention comprises:

- a nozzle (1) apt to direct a steam jet toward the surface of a cliché roll (2) or of an anilox roll (3): said nozzle (1) being fed by steam feeding means through a respective flexible tube (4);
- an suction chamber (5) within which is disposed said nozzle (1) and apt to provide a suction effect in correspondence of the surface of the cliché roll (2) or of the anilox roll (3) interested by the steam jet supplied by the nozzle (1): said chamber (5) being connected to suction means by one or more flexible tubes (6).

Ink is distributed on said rolls (2, 3) in a traditional manner.

More in particular, referring to the example of the annexed drawings, said suction chamber (5) is delimited by the inner lateral walls (50) of a first box-shaped body (51; 510) and by the outer lateral walls (53) of a second body (52) which is internal to the first body (51; 510) and which acts as a support for the nozzle (1). A base (55) of said chamber (5) is delimited by a surface provided with two apertures (56) for connecting it to the suction ducts (6) and further provided with an aperture (54) for connecting it to the said duct (4). The aperture (54) for the steam supplying duct is in a substantially central position in respect to the other two apertures (56) and constitutes an end section of a duct (540) internal to said second body (52) which, on the opposite side, is connected to the nozzle (1), so that the steam reaches the latter through the duct (4), the aperture (54) and the duct (540). The other base (57) of the chamber (5), i.e. the base opposite to the base on which the ducts (4) and (6) are connected, is open and it features a substantially arc-shaped outline whose radius is slightly greater than the radius of the cliché and anilox rolls (2, 3); the concavity of said base (57) destined to face the surface of one of the two rolls (2, 3) leaving a short gap between the same base and the roll.

Said apertures (54, 56, 79) are fast coupling connections which allow to provide the cleaning device of the invention with a cleaning head (51; 510) suitably shaped in respect to the roll to be cleaned. The fast coupling system allows to associate a main body (59) of the device to a cleaning head (51; 510), with the relevant link between the connections provided on the main body (59) and the correspondent supplying and aspirating ducts provided on the cleaning heads. Referring to the not limiting example shown in the drawings, there are two cleaning heads, marked with (51) and (510) and respectively shaped in order to allow the cleaning of the cliché roll (2) and of the anilox roll (3); in practice, it is possible to associate, to a main body (59) of the device (the movement of which will de described later), alternatively the cleaning head (51) for the cliché roll, or the cleaning head (510) for the anilox roll, without modifying neither the positioning nor the movement means of the system. In the shown embodiment, the cleaning head (51) for the cliché roll (2) has a length smaller than the other head (510); obviously, the dimensions can vary according to the dimensions and the positioning of the parts to be cleaned. Moreover, what said relating to the dimensions of the cleaning heads (51; 510) concerns not only the respective external walls or structures but also the respective internal elements.

Advantageously, both said first body (51) and the second body (52) have, in correspondence of the said open base (57) of the chamber (5), a plurality of holes (7, 8) facing the surface of the roll (2, 3) to be cleaned, and connected to compressed air supplying means by a corresponding flexible duct (9). More in particular, the holes (7) of the first body (51; 510) are connected to a first distribution chamber (70) developed transversally to the same holes, i.e. parallel to the axis of the cliché and anilox rolls (2, 3). Said distribution chamber (70) is supplied by the duct (9) through a corresponding connecting joint (79). And the holes (8) of the second body (52) are connected to a second distribution chamber (80) parallel to said first chamber (70) and supplied by the duct (9) through a corresponding offtake (78). Said holes (7, 8) for the outlet of the compressed air are aligned according to two corresponding planes, forming, in this way, two compressed air supplying fronts which are on the same side in respect to the nozzle (1) supported by the second body (52); the holes are oriented toward the surface of the roll to be cleaned ad are spaced to each other of a predetermined amount (d). More particularly, said fronts formed by the holes (7, 8) are downstream of the nozzle (1) in respect to the rotation direction of the cliché roll (2). The compressed air directed to the surface of the roll in treatment cooperates with the steam, for cleaning said surface, contributing to ensure a greater and more effective cleaning effect.

The main body (59) of the device of the invention is mounted on a guide (93) which is developed parallel to the rolls to be cleaned. In practice, the body (59), by means of a plate (88), is made solid to a carriage (89) which, in a traditional manner, is bi-directionally movable along said guide (93), driven by relevant motor means of known type, not shown. Preferably, the carriage (89) is moved bi-directionally along the guide (93) while the roll (2, 3) to be cleaned is in rotation, also when the interested roll is operative, i.e. during the printing. The translation speed of the carriage is related to the rotation speed of the relevant roll to be cleaned.

A cable carrier (98), of known type, is connected to said body (59); supplying ducts are disposed inside said carrier. In particular, within the cable carrier (98), which is covered by an external protection (87), are provided two suction tubes (96), connected to said ducts (6), a tube (94) for supplying the steam, connected to said duct (4), and a tube (99) for compressed air, connected to said duct (9).

According to the present invention is therefore provided a method for the cleaning of rolls, especially for printing machines used for web-shaped paper-like material destined to the production of tissue paper, napkins, toilet paper and the like. According to the present method, provision is made for cleaning the roll by means of a steam jet directed to the roll surface and suction of the particles thus removed from the roll surface.

Advantageously, the steam jet can be continuous or discontinuous; in the latter case, especially for relatively low speed of rotation of the rolls, the roll surface is "hammered", thus producing an advantageous cleaning effect. In other words, the continuousness or discontinuousness of the steam jet can be decided according to the chosen cleaning procedure.

Moreover, it is possible to add to the liquid to be vaporised a detergent, of known type, for further increasing the cleaning action of the system.

The moving, driving and controlling means of the above mentioned elements are known to those skilled in the industrial automation field and will not, therefore, be described in greater detail.

The construction details may vary in any equivalent way as far as the shape, dimensions, elements disposition, nature of the used materials are concerned, without nevertheless departing from the scope of the adopted solution idea and, thereby, remaining within the limits of the protection granted to the present patent.

The invention claimed is:

1. A device for cleaning rolls in printing machines, especially machines for executing prints on web-shaped paper-like material used in producing tissue paper, napkins, toilet paper and the like, the device comprising:

a compressed air feeding means;

a suction means for producing aspiration;

a steam feeding means;

a first box-shaped body having lateral inner walls;

a second body having lateral outer walls, said second body being located within said first box-shaped body;

a base element having a surface defining a first aperture, a second aperture and a third aperture, said first aperture and said second aperture being in communication with said suction means, said third aperture being in communication with said steam feeding means;

a nozzle for directing a steam jet toward a surface of a roll to be cleaned, said nozzle being connected to said steam feeding means, said second body supporting said nozzle;

a suction chamber defined by said lateral inner walls of said first box-shaped body, said lateral outer walls of said second body and said surface of said base element, said nozzle being located within said suction chamber, said suction chamber being connected to said suction means, said suction chamber being disposed opposite an area of the roll such that said area corresponds to the surface of the roll that receives the steam jet from said nozzle a plurality of holes located opposite the surface of the roll to be cleaned, each hole being connected to said compressed air feeding means.

2. A device according to claim 1, wherein said plurality of holes are arranged in two rows, wherein the holes of each row are aligned in a corresponding plane such that two supplying fronts are formed for delivering compressed air to the surface of the roll, each row of holes being located on the same side with respect to said nozzle.

3. A device according to claim 1, further comprising a main body having a fast coupling means for fixing, one at a time, different cleaning heads for cleaning a plurality of rolls, each cleaning head corresponding to one of the rolls to be cleaned.

4. A device according to claim 3, wherein said main body is supported by a carriage bi-directionally movable along a guide parallel to the roll to be cleaned.

5. A device according to claim 1, wherein said plurality of holes are located on said first body and said second body each said plurality of holes being connected to said compressed air feeding means via a flexible duct, said flexible duct having an offtake portion, said first body defining a first distribution chamber, said holes of the first body being in communication with said first distribution chamber, said first body having a connecting joint connected to said flexible duct, said first distribution chamber extending in a transverse direction of said holes of said first body, said first distribution chamber receiving compressed air from said compressed air feeding means via said connecting joint and said flexible duct, said second body defining a second distribution chamber, said second distribution chamber being parallel to said first distribution chamber, the holes of the second body being in communication with said second distribution chamber, each hole of the second body being supplied compressed air from said compressed air feeding means via said offtake portion of said flexible duct, said holes arranged on said first body being aligned in a first plane and said holes being arranged on said second body being aligned in a second plane such that two compressed air supplying fronts are formed on the same side of said nozzle.

6. A device for cleaning rolls in printing machines, the device comprising:

an compressed air feeding means;

a suction means;

a steam feeding means;

a nozzle for directing a steam jet toward a surface of a roll to be cleaned, said nozzle being connected to said steam feeding means;

a first body element having lateral inner walls, one of said lateral inner walls defining a plurality of first holes, each first hole being connected to said compressed air feeding means;

a second body element having lateral outer walls, said lateral inner walls of said first body element surrounding said lateral outer walls of said second body element such that said second body element is located within said first body element, one of said lateral outer walls defining a plurality of second holes, each second hole being connected to said compressed air feeding means;

a base element connected to said first body element and said second body element, said base element defining a first aperture, a second aperture and a third aperture, said first aperture and said second aperture being in communication with said suction means, said third aperture being in communication with said steam feeding means;

a suction chamber defined by said lateral inner walls of said first body element, said lateral outer walls of said second body and said base element, said nozzle being connected to said second body element, said suction chamber being in communication with said first aperture and said second aperture such that said suction chamber is connected to said suction means, said suction means producing a vacuum in an area adjacent to said second body such that said nozzle is surrounded by said vacuum.

7. A device according to claim 6, wherein said plurality of first holes are arranged in a first row and said plurality of second holes are arranged in a second row, said first row of said first holes being parallel to said second row of said second holes, said first row and said second row being located on one side of said nozzle.

8. A device according to claim 7, further comprising a main body having a fast coupling means for fixing, one at a time, different cleaning heads, each cleaning head corresponding to a different roll to be cleaned.

9. A device according to claim 8, further comprising a carriage and a guide element extending parallel to the roll to be cleaned, said main body being supported via said carriage, said carriage being bi-directionally movable along said guide in a direction parallel to the roll to be cleaned.

10. A device according to claim 6, further comprising a flexible tube having an offtake portion, wherein said plurality of first holes are connected to said compressed air feeding means via said flexible tube, said first body element defining a first distribution chamber, said plurality of first holes being in communication with said first distribution chamber, said first body element having a connecting joint connected to said flexible tube, said first distribution chamber extending in a direction perpendicular to said plurality of first holes, said first distribution chamber receiving compressed air from said compressed air feeding means via said connecting joint and said flexible tube, said second body element defining a second distribution chamber, said second distribution chamber being parallel to said first distribution chamber, said plurality of second holes of the second body being in communication with said second distribution chamber, each second hole of said plurality of second holes receiving compressed air from said compressed air feeding means via said offtake portion of said flexible tube, said plurality of first holes being aligned in a first plane and said plurality of second holes being aligned in a second plane such that said first plane is parallel to said second plane, said plurality of first holes and said plurality of second holes being located on one side of said nozzle.

11. A device according to claim 6, wherein each first hole is located adjacent another first hole to form a first row of first holes, each second hole being located adjacent another second hole to form a second row of second holes, said first row of first holes being parallel to said second row of second holes.

12. A device for cleaning rolls in printing machines, the device comprising:

a suction means;

a steam feeding means;

a nozzle for directing a steam jet toward a surface of a roll to be cleaned, said nozzle being connected to said steam feeding means;

a first body element having lateral inner walls;

a second body element having lateral outer walls, said lateral inner walls of said first body element surrounding said lateral outer walls of said second body element such that said second body element is located within said first body element;

a base element connected to said first body element and said second body element, said base element defining a first aperture, a second aperture and a third aperture, said first aperture and said second aperture being in communication with said suction means, said third aperture being in communication with said steam feeding means;

a suction chamber defined by said lateral inner walls of said first body element, said lateral outer walls of said second body and said base element, said nozzle being connected to said second body element, said suction chamber being in communication with said first aperture and said second aperture such that said suction chamber is connected to said suction means, said suction means producing a suction force in an area surrounding said nozzle.

13. A device according to claim 12, further comprising a compressed air feeding means, wherein one of said lateral inner walls defines a plurality of first holes, each first hole being located opposite the surface of the roll to be cleaned, each first hole being connected to said compressed air feeding means, one of said lateral outer walls defining a plurality of second holes, each second hole being located opposite the surface of the roll, each second hole being connected to said compressed air feeding means.

14. A device according to claim 13, wherein said plurality of first holes are arranged in a first row and said plurality of second holes are arranged in a second row, said first row of said first holes being parallel to said second row of said second holes, said first row and said second row being located on one side of said nozzle.

15. A device according to claim 14, further comprising a main body having a fast coupling means for fixing, one at a time, different cleaning heads, each cleaning head corresponding to a different roll to be cleaned.

16. A device according to claim 12, further comprising a main body having a fast coupling means for fixing, one at a time, different cleaning heads, each cleaning head corresponding to a different roll to be cleaned.

17. A device according to claim 15, further comprising a carriage and a guide element extending parallel to the roll to be cleaned, said main body being supported via said carriage, said carriage being bi-directionally movable along said guide in a direction parallel to the roll to be cleaned.

18. A device according to claim 16, further comprising a carriage and a guide element extending parallel to the roll to be cleaned, said main body being supported via said carriage, said carriage being bi-directionally movable along said guide in a direction parallel to the roll to be cleaned.

19. A device according to claim 12, further comprising a flexible tube having an offtake portion, wherein said plurality of first holes are connected to said compressed air feeding means via said flexible tube, said first body element defining a first distribution chamber, said plurality of first holes being in communication with said first distribution chamber, said first body element having a connecting joint connected to said flexible tube, said first distribution chamber extending in a direction perpendicular to said plurality of first holes, said first distribution chamber receiving compressed air from said compressed air feeding means via said connecting joint and said flexible tube, said second body element defining a second distribution chamber, said second distribution chamber being parallel to said first distribution chamber, said plurality of second holes of the second body being in communication with said second distribution chamber, each second hole of said plurality of second holes receiving compressed air from said compressed air feeding means via said offtake portion of said flexible tube, said plurality of first holes being aligned in a first plane and said plurality of second holes being aligned in a second plane such that said first plane is parallel to said second plane, said plurality of first holes and said plurality of second holes being located on one side of said nozzle.

20. A device according to claim 13, wherein each first hole is located adjacent another first hole to form a first row of first holes, each second hole being located adjacent another second hole to form a second row of second holes, said first row of first holes being parallel to said second row of second holes.

* * * * *